US007866199B2

(12) United States Patent
Hirase et al.

(10) Patent No.: US 7,866,199 B2
(45) Date of Patent: Jan. 11, 2011

(54) METHOD FOR MANUFACTURING SEAMLESS STEEL PIPE MADE OF HIGH CR-HIGH NI ALLOY STEEL

(75) Inventors: Naoya Hirase, Wakayama (JP); Tomio Yamakawa, Nishinomiya (JP); Kazuhiro Shimoda, Nishinomiya (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 4 days.

(21) Appl. No.: 12/457,978

(22) Filed: Jun. 26, 2009

(65) Prior Publication Data

US 2010/0000281 A1 Jan. 7, 2010

Related U.S. Application Data

(63) Continuation of application No. PCT/JP2007/075123, filed on Dec. 27, 2007.

(30) Foreign Application Priority Data

Dec. 28, 2006 (JP) ..... 2006-353578

(51) Int. Cl.
*B21D 31/00* (2006.01)

(52) U.S. Cl. ..... 72/364; 72/69; 72/97; 72/365.2; 72/700

(58) Field of Classification Search ..... 72/12.2, 72/69, 96, 97, 200, 202, 208, 209, 342.1, 72/364, 365.2, 367.1, 700; 148/325, 327, 148/427

See application file for complete search history.

(56) References Cited

U.S. PATENT DOCUMENTS 6,918,968 B2 * 7/2005 Semba et al. ..... 148/327
7,146,836 B2 * 12/2006 Hayashi ..... 72/97

FOREIGN PATENT DOCUMENTS

| | | |
|---|---|---|
| JP | 64-31505 | 2/1989 |
| JP | 8-229606 | * 10/1996 |
| JP | 10-180312 | 7/1998 |
| JP | 11-169914 | 6/1999 |
| JP | 2000-334505 | 12/2000 |
| JP | 2001-137913 | 5/2001 |
| WO | 2004/108310 | 12/2004 |

* cited by examiner

*Primary Examiner*—Edward Tolan
(74) *Attorney, Agent, or Firm*—Clark & Brody

(57) ABSTRACT a billet made of high Cr-high Ni alloy, which contains, by mass percent, 20 to 30% of Cr, 30 to 50% of Ni, and at least one element selected from Mo and W with a value "Mo+0.5W" of 1.5% or more is heated under conditions satisfying the following formula (1), and then the billet is pierced and rolled using an inclined roll type piercing mill with a roll gouge circumferential speed of 2.28 m/sec or higher. This prevents melted rash on the inner surface and lengthens the plug life.

$$T \leqq 1575 - 4.45 \times V_f - 104.7 \times \{-\ln(t_h/r_o)\} \quad (1)$$

wherein T indicates a heating temperature (° C.) of the billet, $V_f$ indicates the roll gouge circumferential speed (m/sec), $r_o$ indicates a radius (mm) of a billet at an entry-side, and $t_h$ indicates a radial thickness (mm) of a pipe after piercing.

17 Claims, 1 Drawing Sheet

METHOD FOR MANUFACTURING SEAMLESS STEEL PIPE MADE OF HIGH CR-HIGH NI ALLOY STEEL

This application is a continuation of International Patent Application No. PCT/JP2007/075123, filed Dec. 27, 2007. This PCT application was not in English as published under PCT Article 21(2).

TECHNICAL FIELD

The present invention relates to a method of piercing rolling a high Cr-high Ni alloy steel billet using an inclined roll type piercing mill.

BACKGROUND ART

In manufacturing a seamless steel pipe or tube (hereinafter often refers to as "pipe"), the Mannesmann mandrel mill system, Mannesmann plug mill system, Mannesmann-Assel mill system, or the like is used to pierce and roll a billet with a round section using a piercing mill. The methods for manufacturing a seamless pipe by these Mannesmann systems include:

piercing and rolling a billet, heated to a predetermined temperature in a heating furnace, using an inclined roll type piercing mill;

expanding and decreasing the radial thickness of the resulting hollow pipe stock using a elongator such as a mandrel mill and a plug mill;

narrowing the outer diameter of the hollow pipe stock using a rolling mill such as stretch reducer and sizing mill, resulting in a finished steel pipe product.

In regard to the production methods of a seamless steel pipe, various inventions are disclosed.

For example, patent document 1 discloses an invention related to manufacturing a pipe stock for a seamless steel pipe by rolling and piercing a high-Cr alloy steel billet containing Cr at 9% or more by weight using a piercing mill after heating the billet in a heating furnace, characterized in rolling the billet in such a condition that δ-ferrite does not occur in the metal structure of the pipe stock. An Example of patent document 1 describes manufacturing a seamless steel pipe from a 12% Cr steel.

Patent document 2 discloses an invention related to piercing and rolling a seamless steel pipe made of high carbon steel containing, by mass percent, C of 0.95 to 1.10% after billet heating, characterized in that the billet-heating temperature is set at 1200° C. or less, and an average strain rate $\epsilon AV$ in the axial direction is set at 2.0 $sec^{-1}$ or less. An Example of patent document 2 describes producing a seamless steel pipe from a steel equivalent to SUJ-2.

In recent years, oil country tubular goods, boiler pipes, and the like are used in increasingly harsh environments. For this reason, properties required to the seamless steel pipes used for the pipes are becoming highly demanding. The pipes used in oil wells which are becoming much deeper and much more corrosive environments. Higher strength and superior corrosion resistance are required the pipes. Superior corrosion resistance in high temperature pure water and hot water including $Cl^-$, especially superior stress corrosion cracking resistance are required to the pipes used in nuclear-power generating facilities, chemical plants, and the like. Therefore, seamless steel pipes, made of high alloy steels containing large quantities of Cr, Ni, and further Mo, are becoming popular.

[Patent document 1] JP H10-180312A

[Patent document 2] JP 2001-137913A

DISCLOSURE OF THE INVENTION

Problems to be Solved by the Invention

A high Cr-high Ni alloy steel containing Mo has a deformation resistance of approximately 2.4 times that of carbon steel, and approximately two times those of a 13% Cr steel and a BBS steel, and thus processability at piercing and rolling deteriorates. This in turn deteriorates the life of a plug used for piercing rolling. In addition, the rolling torque increases and the temperature is greatly increased by the heat generation on the piercing. Rise in temperature during piercing and rolling poses the problem of grain boundary melting cracking (melted rash on the inner surface) occurring inside the radial thickness.

This problems is nowhere described or suggested in patent document 1, which target a 12% Cr steel pipe, and patent document 2, which target a steel pipe equivalent to SUJ-2. No documents are found that refer to problems unique to seamless steel pipes made of high Cr-high Ni alloy steels containing Mo. No documents refer to, an appropriate billet heating temperature determined by the relationship between rolling circumferential speed and the working ratio of the radial thickness in order to solve the problems associated with the seamless steel pipes.

The present inventors conducted a detailed study of the relationship between the heating temperature and the rolling circumferential speed in the manufacturing process of the seamless steel pipe made of high Cr-high Ni alloy containing Mo, in order to solve the problem of melted rash on the inner surface. However, they cannot find to completely prevent the melted rash on the inner surface merely by adjusting the said relationship. Meanwhile, decreasing the rolling speed inhibits the processing heat, but problems occur including prolonged period of time for rolling and extreme deterioration of the plug life because of increased deformation resistance of the material to be rolled.

It is an objective of the present invention to provide a method for manufacturing a seamless steel pipe made of high Cr-high Ni alloy capable of preventing melted rash on the inner surface of a pipe stock after pierced using an inclined roll type piercing mill while prolonging the plug life.

Means to Solve the Problems

The gist of the present invention is a method for manufacturing a seamless steel pipe of high Cr-high Ni alloy described below.

(1) A method for manufacturing a seamless steel pipe from a billet made of high Cr-high Ni alloy, which contains, by mass percent, 20 to 30% of Cr, 30 to 50% of Ni, and at least one element selected from Mo and W with a value "Mo+0.5W" of 1.5% or more, characterized by, heating the billet under conditions satisfying the following formula (1), and then piercing and rolling the billet using the inclined roll type piercing mill with a roll gouge circumferential speed of 2.28 m/sec or higher:

$$T \leqq 1575 - 4.45 \times V_f - 104.7 \times \{-\ln(t_H/r_o)\} \quad (1)$$

wherein T indicates a heating temperature (° C.) of the billet, $V_f$ indicates the roll gouge circumferential speed (m/sec), $r_o$ indicates a radius (mm) of a billet at an entry-side, and $t_h$ indicates a radial thickness (mm) of a pipe after piercing.

(2) The method for manufacturing a seamless steel pipe according to described above (1), wherein the heating temperature of the billet is in a range between 1180 and 1250° C.

(3) The method for manufacturing a seamless steel pipe according to described above (1) or (2), wherein the roll gouge circumferential speed is set to 2.28 m/sec or higher and 4.6 m/sec or lower.

(4) The method for manufacturing a seamless steel pipe according to any one of described above (1) to (3), wherein the piercing is carried out at a piercing ratio of 3 or less.

(5) The method for manufacturing a seamless steel pipe according to any one of described above (1) to (4), wherein the billet has a length of 7 m or less.

(6) The method for manufacturing a seamless steel pipe according to any one of described above (1) to (5), wherein the billet contains, by mass percent, C: 0.04% or less, Si: 0.5% or less, Mn: 0.01 to 3.0%, P: 0.03% or less, S: 0.03% or less, Ni: 30 to 50%, Cr: 20 to 30%, Cu: 0.01 to 1.5%, Al: 0.20% or less, N: 0.0005 to 0.2%, Ca: 0.01% or less, and at least one element selected from Mo: 10% or less and W: 20% or less, and the balance: Fe and impurities.

EFFECTS OF THE INVENTION

The method for manufacturing a seamless steel pipe of the present invention prevents melted rash on the inner surface caused by grain boundary melting and the invention improves the plug life, when a billet made of a high Cr-high Ni alloy containing Mo, which has poor deformability and extremely large resistance against deformation, is pieced and rolled by the inclined roll type piercing mill.

DESCRIPTION OF REFERENCE NUMERAL

Figure 1:
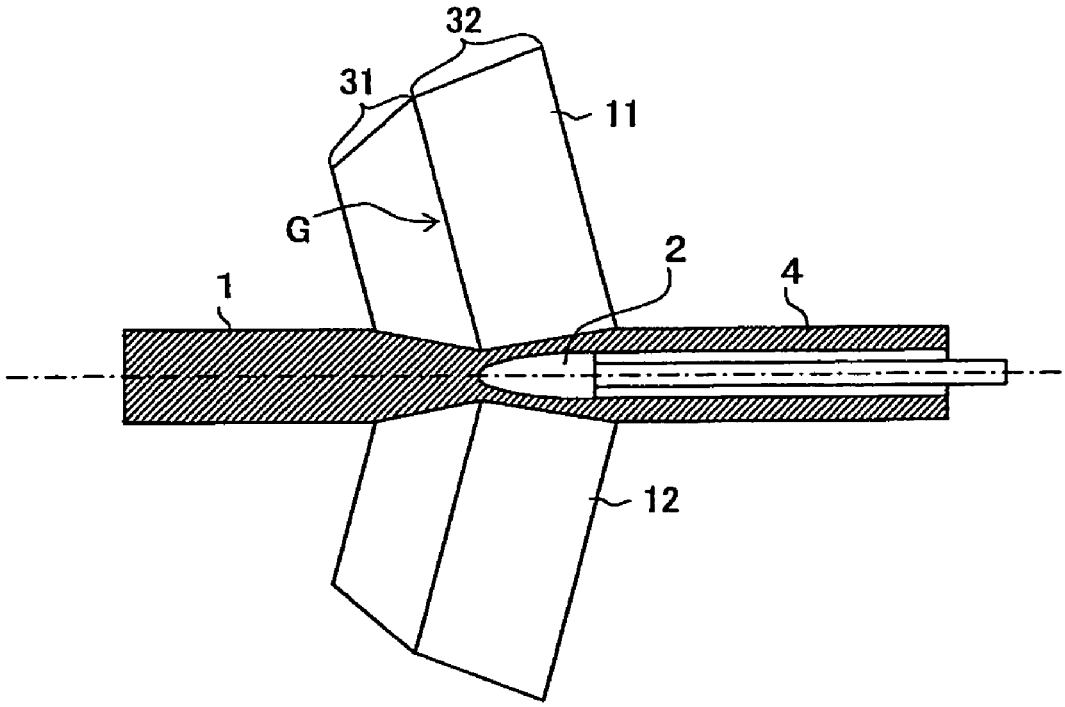
FIG. 1 is a diagram exemplifying a manufacturing apparatus of a seamless steel pipe of high Cr-high Ni alloy using a cone-type roll.

| | |
|---|---|
| 1. | Billet |
| 11, 12, 13, 14. | Roll |
| 2. | Plug |
| 31. | Entry side surface |
| 32. | Exit side surface |
| 4. | Pipe stock |
| G. | Roll gouge |

BEST MODE FOR CARRYING OUT THE INVENTION

(a) Chemical Composition of a Billet

A billet applied to the method for manufacturing a seamless steel pipe of the present invention contains 20 to 30% of Cr, 30 to 50% of Ni, and at least one element selected from Mo and W with a value "Mo+0.5W" of 1.5% or more.

Cr: 20 to 30%

Cr is an element that improves corrosion resistance and the content is set to 20% or more. When the content exceeds 30%, hot workability is adversely affected. In view of this, the content of Cr was set between 20% and 30%.

Ni: 30 to 50%

Ni is an effective element that improves corrosion resistance and the content is set to 30% or more. However, this effect is saturated when the content exceeds 50%. In view of this, the content of Ni was set between 30% and 50%.

Mo+0.5W: 1.5% or More

Mo and W are elements that improve pitting corrosion resistance, and either one or both of them can be added. However, this effect cannot be obtained when the value of "Mo+0.5W" is less than 1.5%, and in view of this, Mo+0.5W is 1.5% or more. Although the upper limit of Mo+0.5W is not particularly specified, an excessive increase only saturates the effect. In view of this, Mo+0.5W is desirably 10% or less.

The billet may contain the following alloy elements in addition to the above-described alloy elements. A desirable range of content of each element and a reason for the limitation will be explained below.

C: 0.04% or Less

C forms carbide with Cr, Mo, Fe, and the like, increase of the content of C causes deterioration of ductility and toughness. In view of this, the C content is desirably limited to 0.04% or less.

Si: 0.5% or Less

Si prevents the generation of the sigma phase and suppresses deterioration of ductility and toughness, therefore, the S content is desirably as small as possible. In view of this, the content of Si is desirably limited to 0.5% or less.

Mo: 0.01 to 3.0%

Mn improves hot workability. Hence, it is desirable to contain 0.01% or more of Mn, but the deterioration of the corrosion resistance may occur if the Mn content is excessive, therefore, the Mn content is desirably set to 3.0% or less. Therefore, when Mn is contained, the Mn content is preferably 0.01 to 3.0%. In particular, in the case where the generation of the σ-phase is problematic, the Mn content is desirably set to 0.01 to 1.0%.

P: 0.03% or Less

P is contained in steel generally as an impurity and adversely affects the hot workability, etc., of steel. In view of this, the P content is desirably limited to 0.03% or less.

S: 0.03% or Less

S is also contained in steel as an impurity and adversely affects the toughness, etc., of steel. In view of this, the S content is desirably limited to 0.03% or less.

Cu: 0.01 to 1.5%

Cu is an effective element to improve creep rupture strength and the content is preferably set to 0.01% or more. However, when the Cu content exceeds 1.5%, alloy ductility may deteriorate. In view of this, the Cu content is desirably limited to 0.01 to 1.5%.

Al: 0.20% or Less

Al is effective as a deoxidation material, but promotes a formation of an intermetallic compound such as a sigma phase. In view of this, the Al content is desirably limited to 0.20% or less.

N: 0.0005 to 0.2%

N is an effective element for a solid solution-strengthening, contributes to higher strength, and also suppresses a formation of an intermetallic compound such as a sigma phase, thereby improves of toughness. In view of this, the N content is desirably 0.0005% or more. However, when the N content exceeds 0.2%, corrosion resistance may deteriorate. In view of this, the N content is desirably 0.0005 to 0.2%.

Ca: 0.005% or Less

Ca fixes S, which damages hot workability, as a sulfide, but when the Ca content is excessive, hot workability deteriorates. In view of this, the Ca content is desirably limited to 0.005% or less.

(b) Conditions for Piercing and Rolling Using Inclined Roll Type Piercing Mill

1. Heating Condition

In the method for manufacturing a seamless steel pipe made of high Cr-high Ni alloy of the present invention, billet is heated under conditions satisfying the following formula (1), and then the inclined piercing-rolling is carried out at a roll gouge circumferential speed of 2.28 m/sec or higher.

$$T \leqq 1575-4.45\times V_f-104.7\times\{-\ln(t_h/r_o)\} \quad (1)$$

wherein T indicates a heating temperature (° C.), $V_f$ indicates the roll gouge circumferential speed (m/sec), $r_o$ indicates a radius (mm) of a billet at an entry-side, and $t_h$ indicates a radial thickness (mm) of a pipe after piercing.

This intends to derive the set temperature of the heating furnace from a formula of the relationship between the radial thickness processing logarithmic strain $\{-\ln(t_h/r_o)\}$ and the rolling circumferential speed ($V_f$) in piercing and rolling using inclined roll type piercing mill. That is, satisfying the formula (1) increases the heating temperature when the processability is relatively small and increases the piercing speed, thereby reducing load on the mill, improving efficiency, and shortening the plug contact time. As a result, the plug life improves.

The heating temperature before the inclined piercing-rolling is particularly desirably in a range of 1180 to 1250° C. Even if the heating temperature satisfies the formula (1), at less than 1180° C. the deformation resistance increases, resulting in a possibility of increased piercing load. This may cause restrictions from the capacity of the inclined roll type piercing mill. In excess of 1250° C., melted rash on the inner surface caused by grain boundary melting is likely to occur.

Lowering the roll gouge circumferential speed causes the increase of the time of piercing and rolling, thus shorting the plug life and reducing production efficiency. In view of this, the roll gouge circumferential speed is set to 2.28 m/sec or higher. Although the upper limit of the roll gouge circumferential speed is not particularly specified, an excessive increase facilitates melted rash on the inner surface caused by grain boundary melting. In view of this, the roll gouge circumferential speed is desirably set to 4.6 m/sec or less.

Figure 2:
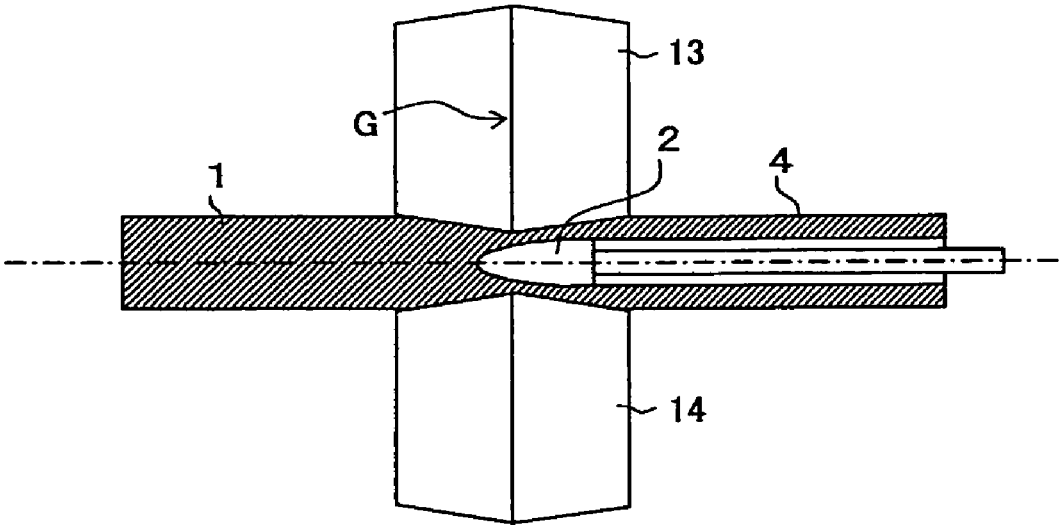
FIG. 2 is a diagram exemplifying manufacturing apparatus of a seamless steel pipe of high Cr-high Ni alloy using a barrel-type roll.

FIGS. 1 and 2 are pattern diagrams exemplifying apparatuses to carry out a method for manufacturing a seamless steel pipe of high Cr-high Ni alloy of the present invention; FIG. 1 is an example using a corn-type roll and FIG. 2 is an example using a barrel-type roll. As shown in FIG. 1 and FIG. 2, a billet 1 proceeds from left to right in the figures and bitten by rotating rolls 11 and 12 (rolls 13 and 14 in FIG. 2) while being pierced by a plug 2 to end up as a pipe stock 4.

As used herein, the "roll gouge" refers to a position where the distance between a pair of rolls becomes smallest. For example, in the case of the rolls 11 and 12 of the corn type shown in FIG. 1, a position G that connects points where an entry surface 31 and an exit surface 32 intersect one another is the roll gouge, while in the case of the barrel-type rolls shown in FIG. 2, a position G where the roll diameter becomes maximum is the roll gouge.

The pipe stock after the piercing and rolling, using an inclined roll type piercing mill, desirably has a length of 7 m or less. This is because the plug life is closely related to the deformation resistance of the billet and the piercing time. That is, a long piercing length makes the plug load large, and thus the plug is melted down and that causes missed rolling such as plug clogging during the piercing and rolling; even if the piercing and rolling can be carried out, the tip part of a plug is abraded and the plug barrel is scarred, resulting in a possibility that the plug may not be a usable state in the next rolling.

EXAMPLE 1

The following experiment was subjected in order to confirm the effects of the present invention. Billets having diameter of 225 mm and length of 2 to 4 m were produced. The billets were made of high Cr-high Ni alloy containing, by mass percent, C: 0.019%, Cr: 26.0%, Ni: 32.3%, Mo: 3.2%, P: 0.028%, and the balance being Fe and impurities. The billet were heated to 1180-1260° C., and then subjected to an experiment of piercing and rolling using an inclined roll type piercing mill with a piercing ratio of 1.5 to 3.0 and a roll gouge circumferential speed of 2.28 to 5.31 m/s. Table 1 shows results of evaluations of melted rash on the inner surfaces of the steel pipes, which were obtained by various manufacturing methods.

TABLE 1

| No. | Heating Temp. of Billets (° C.) | Peircing Ratio | Value of Formila (1) | Adequecy | $-\ln(t_h/r_o)$ | Roll Speed $V_f$ (m/sec) | Evaluation of Melt Cracking |
|---|---|---|---|---|---|---|---|
| 1 | 1180.0 | 1.5 | 1,269.6 | adequate | 2.82 | 2.28 | ○ |
| 2 | 1180.0 | 1.5 | 1,259.5 | adequate | 2.82 | 4.55 | ○ |
| 3 | 1180.0 | 2.0 | 1,232.1 | adequate | 3.13 | 3.41 | ○ |
| 4 | 1180.0 | 3.0 | 1,223.9 | adequate | 3.16 | 4.55 | ○ |
| 5 | 1180.0 | 3.0 | 1,179.7 | inadequate | 3.55 | 5.31 | X |
| 6 | 1180.0 | 3.5 | 1,176.4 | inadequate | 3.71 | 2.28 | X |
| 7 | 1200.0 | 1.5 | 1,269.6 | adequate | 2.82 | 2.28 | ○ |
| 8 | 1200.0 | 1.5 | 1,259.5 | adequate | 2.82 | 4.55 | ○ |
| 9 | 1200.0 | 2.0 | 1,232.1 | adequate | 3.13 | 3.41 | ○ |
| 10 | 1200.0 | 3.0 | 1,223.9 | adequate | 3.16 | 4.55 | ○ |
| 11 | 1200.0 | 3.0 | 1,193.2 | inadequate | 3.55 | 2.28 | X |
| 12 | 1200.0 | 3.5 | 1,166.3 | inadequate | 3.71 | 4.55 | X |
| 13 | 1210.0 | 1.4 | 1,272.9 | adequate | 2.74 | 3.41 | ○ |
| 14 | 1210.0 | 1.4 | 1,264.5 | adequate | 2.74 | 5.31 | ○ |
| 15 | 1210.0 | 2.0 | 1,232.1 | adequate | 3.13 | 3.41 | ○ |
| 16 | 1210.0 | 3.0 | 1,223.9 | adequate | 3.16 | 4.55 | ○ |
| 17 | 1210.0 | 2.5 | 1,208.0 | inadequate | 3.36 | 3.41 | X |

TABLE 1-continued

| No. | Heating Temp. of Billets (° C.) | Peircing Ratio | Value of Formila (1) | Adequecy | $-\ln(t_h/r_o)$ | Roll Speed $V_f$ (m/sec) | Evaluation of Melt Cracking |
|---|---|---|---|---|---|---|---|
| 18 | 1210.0 | 2.5 | 1,203.0 | inadequate | 3.36 | 4.55 | X |
| 19 | 1220.0 | 1.4 | 1,278.0 | adequate | 2.74 | 2.28 | ○ |
| 20 | 1220.0 | 1.4 | 1,267.9 | adequate | 2.74 | 4.55 | ○ |
| 21 | 1220.0 | 2.0 | 1,237.1 | adequate | 3.13 | 2.28 | ○ |
| 22 | 1220.0 | 2.0 | 1,227.0 | adequate | 3.13 | 4.55 | ○ |
| 23 | 1220.0 | 2.5 | 1,208.0 | inadequate | 3.36 | 3.41 | X |
| 24 | 1220.0 | 2.5 | 1,206.3 | inadequate | 3.36 | 3.79 | X |
| 25 | 1230.0 | 1.4 | 1,278.0 | adequate | 2.74 | 2.28 | ○ |
| 26 | 1230.0 | 1.4 | 1,267.9 | adequate | 2.74 | 4.55 | ○ |
| 27 | 1230.0 | 2.0 | 1,237.1 | adequate | 3.13 | 2.28 | ○ |
| 28 | 1230.0 | 2.0 | 1,227.0 | inadequate | 3.13 | 4.55 | X |
| 29 | 1230.0 | 2.5 | 1,213.1 | inadequate | 3.36 | 2.28 | X |
| 30 | 1230.0 | 2.5 | 1,203.0 | inadequate | 3.36 | 4.55 | X |
| 31 | 1240.0 | 1.4 | 1,267.9 | adequate | 2.74 | 4.55 | ○ |
| 32 | 1240.0 | 1.4 | 1,272.9 | adequate | 2.74 | 3.41 | ○ |
| 33 | 1240.0 | 2.0 | 1,237.1 | inadequate | 3.13 | 2.28 | X |
| 34 | 1240.0 | 2.0 | 1,232.1 | inadequate | 3.13 | 3.41 | X |
| 35 | 1240.0 | 2.5 | 1,213.1 | inadequate | 3.36 | 2.28 | X |
| 36 | 1240.0 | 2.5 | 1,208.0 | inadequate | 3.36 | 3.41 | X |
| 37 | 1250.0 | 1.4 | 1,278.0 | adequate | 2.74 | 2.28 | ○ |
| 38 | 1250.0 | 1.4 | 1,272.9 | adequate | 2.74 | 3.41 | ○ |
| 39 | 1250.0 | 1.8 | 1,249.7 | inadequate | 3.01 | 2.28 | X |
| 40 | 1250.0 | 2.0 | 1,232.1 | inadequate | 3.13 | 3.41 | X |
| 41 | 1250.0 | 2.5 | 1,213.1 | inadequate | 3.36 | 2.28 | X |
| 42 | 1250.0 | 2.5 | 1,208.0 | inadequate | 3.36 | 3.41 | X |
| 43 | 1260.0 | 1.6 | 1,252.2 | inadequate | 2.89 | 4.55 | X |
| 44 | 1260.0 | 3.2 | 1,185.8 | inadequate | 3.62 | 2.28 | X |

[Evaluation of Melt Cracking]
○: existing no melt cracking
X: existing a melt cracking Table 1 indicates that examples No. 1 to 4, 7 to 10, 13 to 16, 19 to 22, 25 to 27, 31, 32, 37, and 38, which satisfied the relationship represented by formula (1), encountered no melt cracking, whereas the other examples, which did not satisfy formula (1), encountered melt cracking.

EXAMPLE 2

Further, billets, having a diameter of 225 mm and a length of 5 to 10 m were produced. The billets were made of high Cr-high Ni alloy containing, by mass percent, C: 0.019%, Cr: 26.0%, Ni: 32.3%, Mo: 3.2%, P: 0.028%, and the balance being Fe and impurities. The billets were heated to 1210° C., and then subjected to an experiment of piercing and rolling using an inclined roll type piercing mill with a piercing ratio of 1.7 to 2.3 and a roll gouge circumferential speed of 3.5 m/s. Pipe stocks having different lengths were rolled and the number of passes was counted until a melting loss occurred on the tip part of the plugs resulting in an unusable state in the next rolling. As indicated below, the plug life remarkably shortened at pipe stock lengths in excess of 7 m.

| Pipe stock length | Number of passes |
|---|---|
| 5 m | 4 |
| 6 m | 4 |
| 7 m | 3 |
| 8 m | 1 |
| 9 m | 0 |
| 10 m | 0 |

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The method for manufacturing a seamless steel pipe of the present invention prevents melted rash on the inner surface caused by grain boundary melting and the invention improves the plug life, when a billet made of a high Cr-high Ni alloy containing Mo, which has poor deformability and extremely large resistance against deformation, is pieced and rolled by the inclined roll type piercing mill.

The invention claimed is:

1. A method for manufacturing a seamless steel pipe from a billet made of high Cr-high Ni alloy, which contains, by mass percent, 20 to 30% of Cr, 30 to 50% of Ni, and at least one element selected from Mo and W with a value "Mo+0.5W" of 1.5% or more, characterized by, heating the billet under conditions satisfying the following formula (1), and then piercing and rolling the billet using the inclined roll type piercing mill with a roll gouge circumferential speed of 2.28 m/sec or higher:

$$T \leqq 1575 - 4.45 \times V_f - 104.7 \times \{-\ln(t_h/r_o)\} \quad (1)$$

wherein T indicates a heating temperature (° C.) of the billet, $V_f$ indicates the roll gouge circumferential speed (m/sec), $r_o$ indicates a radius (mm) of a billet at an entry-side, and $t_h$ indicates a radial thickness (mm) of a pipe after piercing.

2. The method for manufacturing a seamless steel pipe according to claim 1, wherein the heating temperature of the billet is in a range between 1180 and 1250° C.

3. The method for manufacturing a seamless steel pipe according to claim 1, wherein the roll gouge circumferential speed is set to 2.28 m/sec or higher and 4.6 m/sec or lower.

4. The method for manufacturing a seamless steel pipe according to claim 2, wherein the roll gouge circumferential speed is set to 2.28 m/sec or higher and 4.6 m/sec or lower.

5. The method for manufacturing a seamless steel pipe according claim 1, wherein the piercing is carried out at a piercing ratio of 3 or less.

6. The method for manufacturing a seamless steel pipe according to claim 2, wherein the piercing is carried out at a piercing ratio of 3 or less.

7. The method for manufacturing a seamless steel pipe according to claim 3, wherein the piercing is carried out at a piercing ratio of 3 or less.

8. The method for manufacturing a seamless steel pipe according to claim 4, wherein the piercing is carried out at a piercing ratio of 3 or less.

9. The method for manufacturing a seamless steel pipe according to claim 1, wherein the billet has a length of 7 m or less.

10. The method for manufacturing a seamless steel pipe according to claim 2, wherein the billet has a length of 7 m or less.

11. The method for manufacturing a seamless steel pipe according to claim 3, wherein the billet has a length of 7 m or less.

12. The method for manufacturing a seamless steel pipe according to claim 4, wherein the billet has a length of 7 m or less.

13. The method for manufacturing a seamless steel pipe according to claim 5, wherein the billet has a length of 7 m or less.

14. The method for manufacturing a seamless steel pipe according to claim 6, wherein the billet has a length of 7 m or less.

15. The method for manufacturing a seamless steel pipe according to claim 7, wherein the billet has a length of 7 m or less.

16. The method for manufacturing a seamless steel pipe according to claim 8, wherein the billet has a length of 7 m or less.

17. The method for manufacturing a seamless steel pipe according to claim 1, wherein the billet contains, by mass percent, C: 0.04% or less, Si: 0.5% or less, Mn: 0.01 to 3.0%, P: 0.03% or less, S: 0.03% or less, Ni: 30 to 50%, Cr: 20 to 30%, Cu: 0.01 to 1.5%, Al: 0.20% or less, N: 0.0005 to 0.2%, Ca: 0.01% or less, and at least one element selected from Mo: 10% or less and W: 20% or less, and the balance: Fe and impurities.

* * * * *